US005155315A

United States Patent [19]

Malkin et al.

[11] Patent Number: 5,155,315

[45] Date of Patent: Oct. 13, 1992

[54] HYBRID MEDIUM VOLTAGE CIRCUIT BREAKER

[75] Inventors: Peter Malkin, Saint-Ismier; Roger Bolongeat-Mobleu, Echirolles, both of France

[73] Assignee: Merlin Gerin, France

[21] Appl. No.: 668,162

[22] Filed: Mar. 12, 1991

[51] Int. Cl.[5] ..... H01H 33/82; H01H 9/30

[52] U.S. Cl. ..... 200/148 R; 200/144 B

[58] Field of Search ..... 200/144 B, 146 A, 146 AA, 200/148 B, 148 R

[56] References Cited

U.S. PATENT DOCUMENTS 3,522,404 8/1970 Trayer .
3,671,696 6/1972 Brunner .
4,109,123 8/1978 Lipperts .

FOREIGN PATENT DOCUMENTS 0204262 12/1986 European Pat. Off. .
2240516 3/1975 France .
1126362 9/1968 United Kingdom .

*Primary Examiner*—Harold Broome
*Attorney, Agent, or Firm*—Parkhurst, Wendel & Rossi

[57] ABSTRACT

The circuit breaker comprises main contacts 26, 30 and a vacuum cartridge 38 in parallel which performs breaking, the assembly being contained in an enclosure 10 filled with sulphur hexafluoride. The cartridge is designed for dielectric withstand in this gas. The contacts of the cartridge 38 are made of high resistive material and a coil generates an axial magnetic field in the arcing zone.

6 Claims, 3 Drawing Sheets

72
70
III
III
74
68

34
68
70
74
42
72
66
46
50
38
40

HYBRID MEDIUM VOLTAGE CIRCUIT BREAKER

The invention relates to a medium voltage electrical circuit breaker comprising a sealed enclosure filled with sulphur hexafluoride, a pair of main contacts disposed in the enclosure, a vacuum cartridge disposed in the enclosure and containing a pair of aligned arcing contacts, which are electrically connected in parallel to the main contacts, an operating mechanism disposed to open the arcing contacts after the main contacts and close them before the main contacts.

Two breaking techniques of medium voltage currents are commonly used, vacuum breaking and breaking in sulphur hexafluoride, each of these techniques having advantages and drawbacks. Vacuum envelopes can be manufactured in large quantities but their breaking capacity is limited and can only be improved by complicated artificial means. Breaking in sulphur hexafluoride is simpler but difficult to standardize. In medium voltage installations with gas insulation and a metal enclosure, vacuum envelopes are placed in the sealed enclosure filled with sulphur hexafluoride, the vacuum envelopes performing interruption of the current and the sulphur hexafluoride insulating the installation components. This state-of-the-art juxtaposition does not take maximum advantage of these two techniques.

Another state-of-the-art circuit breaker comprises arcing contacts housed in a vacuum cartridge and main contacts connected in parallel with the arcing contacts and housed in an enclosure filled with sulphur hexafluoride. The main contacts, which open after the arcing contacts, are thus protected from the arcs and are capable of conveying strong currents. The operation of the vacuum cartridge and its structure are standard.

The object of the present invention is to combine the advantages of both the techniques, of using vacuum and sulphur hexafluoride. This object is achieved by producing a circuit breaker, characterized in that the insulating enclosure of the vacuum cartridge comprises a cylindrical surface, coaxially surrounding the arcing contacts, whose axial length, defining the creepage distance, corresponds to the dielectric withstand of the enclosure in sulphur hexafluoride. Also included are means for producing an axial magnetic field in the formation zone of an arc, which is drawn inside the cartridge when the arcing contacts separate. The arcing contacts are diskshaped and made of high resistive material.

Current breaking is performed in the vacuum cartridge by the arcing contacts which perform their usual role of protecting the main contacts, which open and close without an arc forming. The vacuum cartridge has no other function and its dimensions, notably its axial length, are reduced to a value ensuring the dielectric withstand of the enclosure in sulphur hexafluoride, notably lower than that necessary for a vacuum cartridge in air. The breaking capacity of the cartridge is increased by generating an axial magnetic field in the arcing zone which diffuses the arc and prevents any concentration of energy at a particular point. This axial magnetic field can be produced by a single coil, for stray fields, due to currents induced in the contacts, which greatly attenuated or even rendered negligible by the high resistivity of the contacts, made of materials which are, for example, refractory. The use of such materials increases the resistance to the action of the arc and favors breaking. The combined use of high resistive contacts, of an axial arc diffusion field, and of a cartridge housed in an enclosure filled with sulphur hexafluoride, ensures a high breaking capacity with a small simplified vacuum cartridge and enables a medium voltage circuit breaker or installation with main contacts and gas insulation to be achieved. A single vacuum cartridge can cover a whole range of circuit breakers and practical manufacture is therefore possible.

The vacuum cartridge comprises a cylindrical enclosure made of ceramic material or glass, sealed off by two advantageously metal plates. The axial length of the cartridge, defined by the voltages involved and/or the pressure of sulphur hexafluoride in the enclosure is generally less than 15 cm, a length notably less than that of standard vacuum enclosures.

The disk-shaped arcing contacts are made of refractory materials such as tungsten, chrome or an alloy of these metals. Other high resistive materials such as stainless steel being can be used. The arcing contacts are disposed axially in the cylindrical cartridge and one of the contacts is slidingly mounted being connected to a mechanism performing separation and reclosing of the arcing contacts before that of the main contacts in a state-of-the-art manner.

The axial field in the breaking zone is generated by current flowing in a coil securedly united to the base-plate of the cartridge, located on the stationary arcing contact side. This coil coaxial to the cartridge and of flattened shape can be formed by a conductor fixed to said base-plate or be defined by a spiral groove cut out of the mass, i.e. from the thickness of the base-plate on the internal face of the cartridge. This coil is connected in series to arcing contacts in the arcing circuit and is shunted in the closed position by the main contacts. The current is switched in the coil, when the main contacts separate, and generates an axial arc diffusion field favoring breaking.

The circuit breaker according to the invention is particularly suited to a gas-insulated medium voltage installation, the three pole-units being able to be housed in a single earthed metal enclosure. Insulation is provided by the sulphur hexafluoride at atmospheric or compressed pressure, and this gas is not liable to be polluted by the breaking arc. The breaking part is confined in the cartridge of small size, which simplifies the structure and design of the whole installation.

Other advantages and features will become more clearly apparent from the following description of an illustrative embodiment of the invention, given as a non-restrictive example only and represented in the accompanying drawings, in which.

Figure 1:
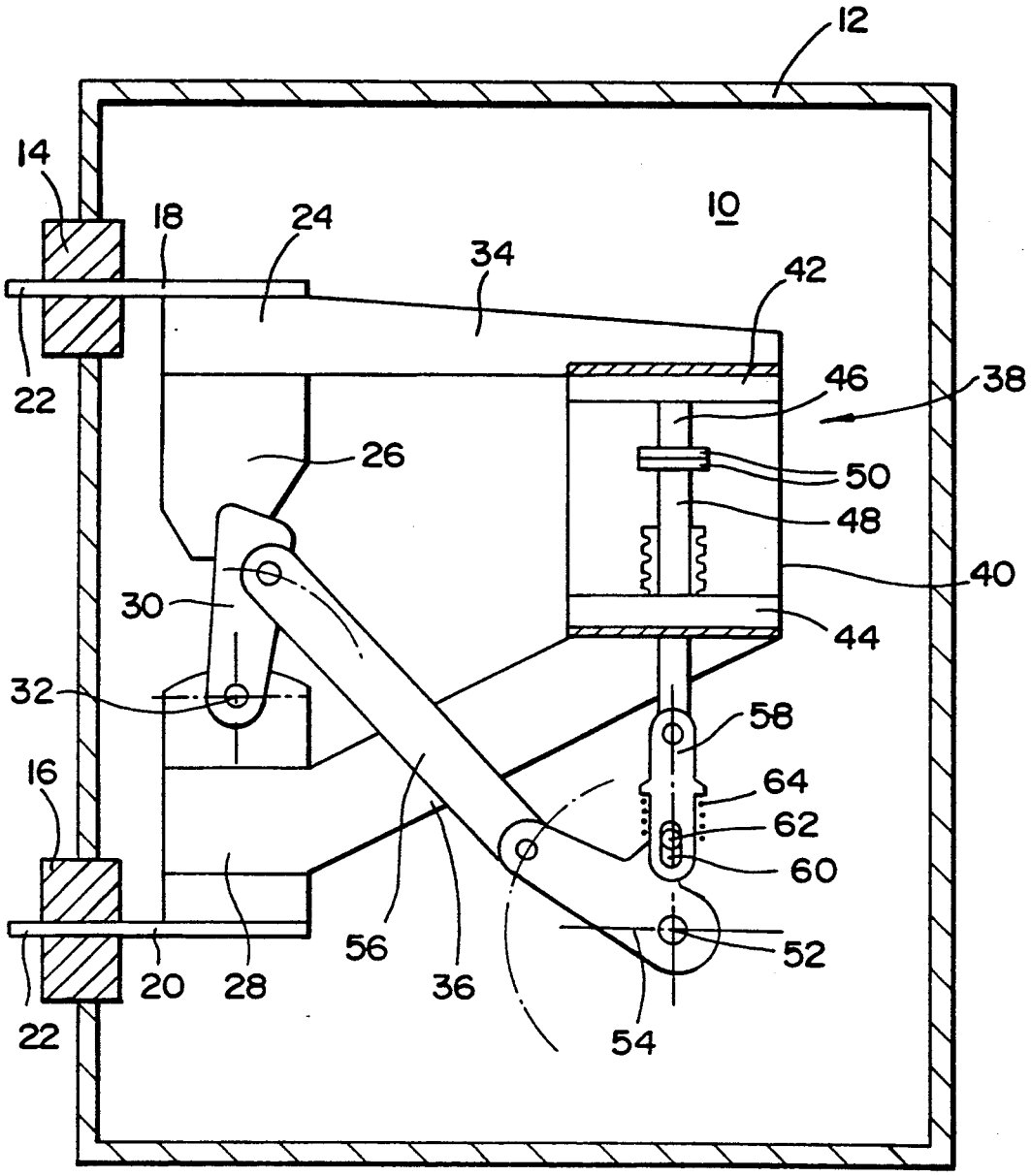
FIG. 1 is a schematic axial sectional view of a circuit breaker according to the invention, represented in the closed position.

In the figures, a medium voltage circuit breaker is housed in a sealed enclosure 10, whose metal or insulating wall 12 can be that of a gas-insulated installation or substation or that of a pole-unit or three pole-units of the circuit breaker. The pole-unit represented in FIG. 1 comprises two sealed bushings 14, 16 of current input 18 and output 20 conductors, which terminate outside the enclosure 10 by connecting pads 22 and inside by a support 24 of a stationary main contact 26 and by a support 28 of a movable main contact 30, respectively. The main contact 30 may be in the form of a knife-blade pivotally mounted on a fixed spindle 32. In the closed position the movable main contact 30 is aligned, and in contact with the stationary main contact 26 to close the main circuit, formed by the input conductor 18, support 24, stationary and movable main contacts, 26, 30 support 28 and output conductor 20. The supports 24, 28 are extended by arms 34, 36 extending transversely, their free ends being located on either side of a vacuum cartridge 38. The cylindrical housing 40 of the cartridge 38 is sealed off at both ends by metal baseplates 42, 44, each mechanically and electrically connected to the free end of the associated arm 34, 36. The axis of the cartridge is appreciably parallel to the main contacts 26, 30 aligned in the closed position and a pair of elongated arcing contacts 46, 48 is disposed coaxially in the cartridge 38. Arcing contact 46 is stationary and securedly united to the base-plate 42, and the other 48 is movable, each bearing a disk-shaped contact part 50. The movable arcing contact 48 passes through the base-plate 44, to which it is electrically connected, with a sealing joint interposed. It can easily be seen that the arms 34, 36, base-plates 42, 44 and arcing contacts 46, 48 with their abutting contact parts 50, form an auxiliary arcing circuit connected in parallel to the main contacts 26, 30.

Figure 2:
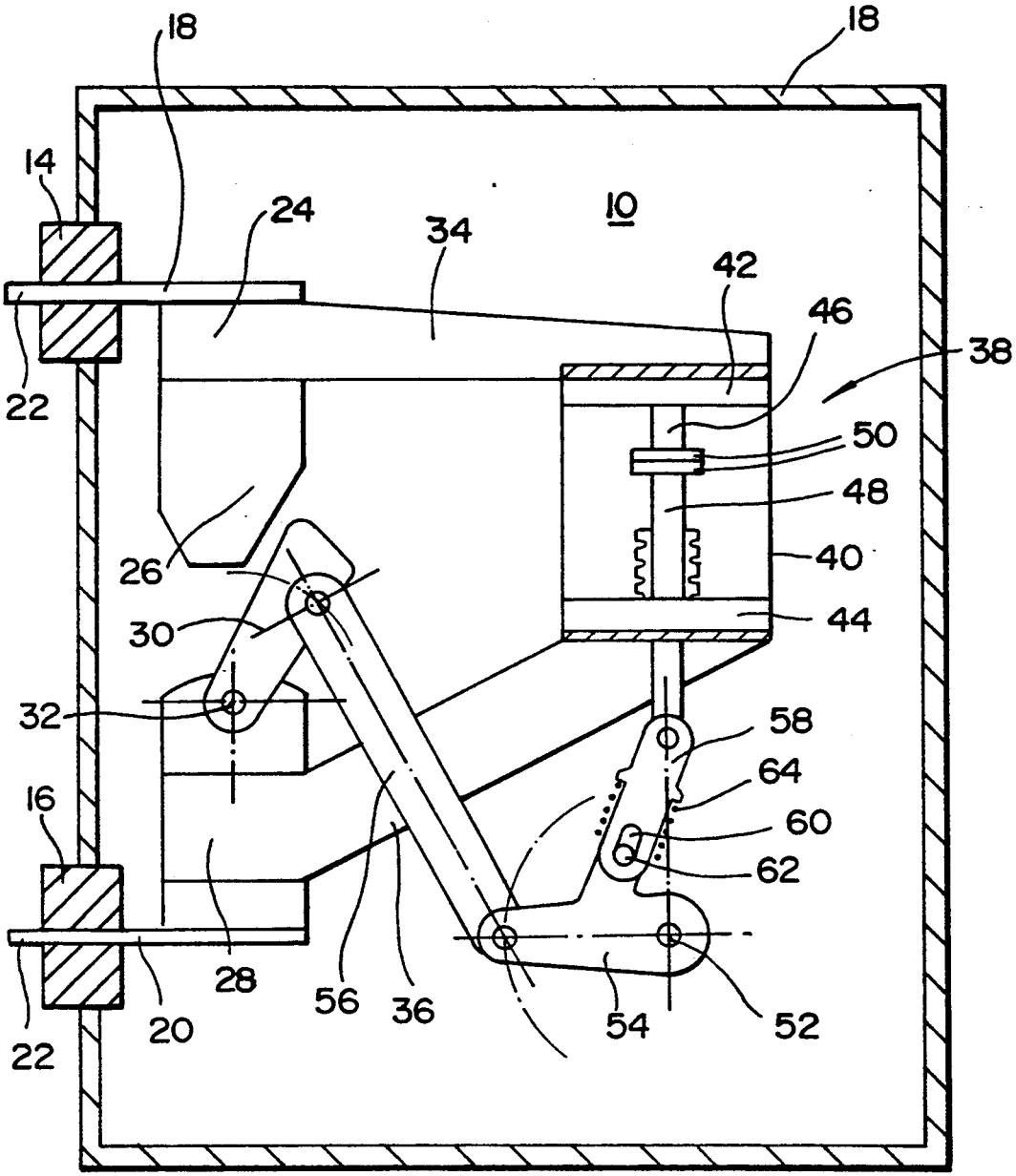
FIG. 2 is a similar view to that of FIG. 1 showing the circuit breaker in the course of opening.

A rotary operating shaft 52 passes through the wall 12 and bears on its inside end a crank 54, connected on the one hand by an articulated connecting rod 56 to the main knife-blade 30 and on the other hand by a small rod 58 and aperture 60 to the movable arcing contact 48. In the aperture 60, arranged in the small rod 58, a crank pin 62 supported by the crank 54 is slidingly mounted so as to form a dead travel link urged in extension by a spring 64. The mechanism is arranged in such a way that in the course of an opening operation of the circuit breaker, commanded by a clockwise rotation of the shaft 52, the main movable contact 30 opens first, the arcing contacts 46, 48 remaining closed at first due to the dead travel from aperture 60 (FIG. 2). The current which was flowing through the main contacts 26, 30 is switched in the arcing circuit without an arc forming on the main contacts 26, 30. Continued rotation of the shaft 52 causes opening of the arcing contacts 46, 48 and final opening of the circuit breaker. The closing operation, commanded by a reverse rotation of the shaft 52, first closes the arcing contacts 46, 48, and then the main contacts 26, 30.

The cylindrical housing 40 of the vacuum cartridge 38 is made of ceramic or glass with a smooth external surface, whose axial length defines the critical creepage distance of the cartridge 38. This axial length is determined in terms of the voltage, to ensure a sufficient dielectric withstand and this length is notably less than that of a cartridge placed in air. In medium voltage, this length is less than or close to 15 cm and the small size of the vacuum cartridge 38 makes it easy to house.

The contact parts 50 of the arcing contacts 46, 48 are made of high resistive material. A refractory material, such as tungsten, chrome or alloys of these metals increases their arcing withstand capability. The high resistivity of these materials is not a drawback, as the permanent current is taken charge of by the main contacts 26, 30. This high resistivity reduces the currents induced in the contact parts 50.

Figure 4:
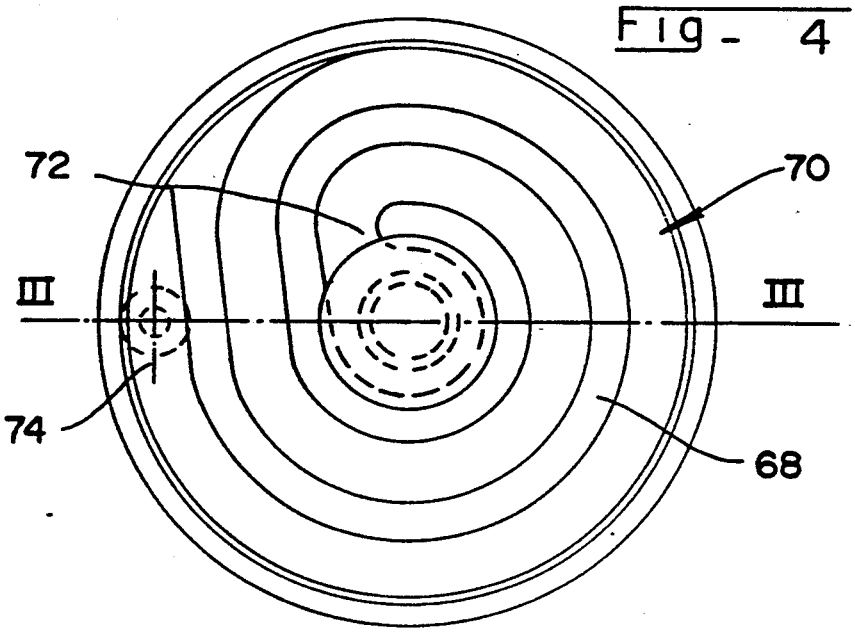
FIG. 4 is a bottom view of the base-plate visible in FIG. 3.
Figure 3:
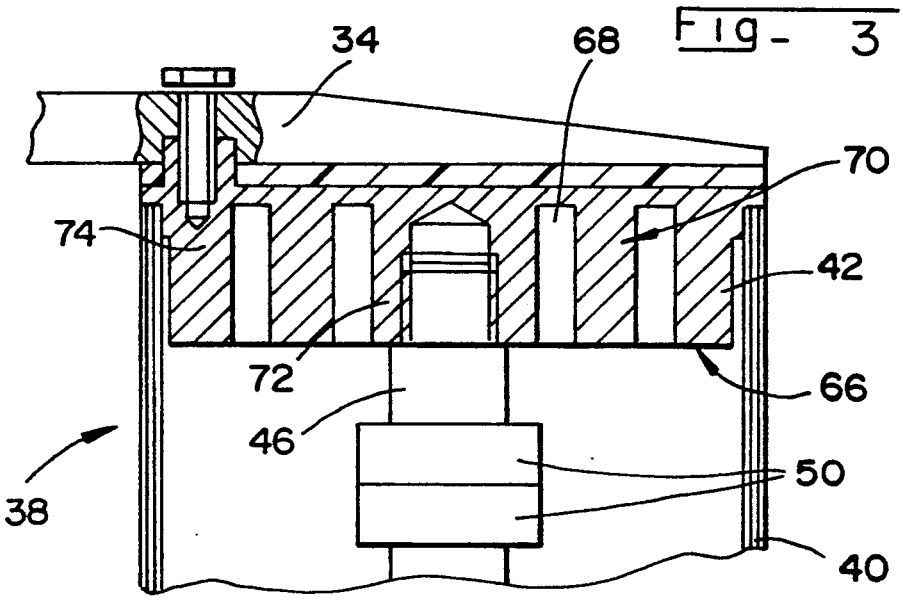
FIG. 3 is a cross-section according to the line III—III of FIG. 4, showing on an enlarged scale a detail of FIG. 1.

Referring more particularly to FIGS. 3 and 4 it can be seen that the base-plate 42, arranged on the stationary arcing contact 46 side, presents on its internal face 66 to the cartridge 38 a deep furrow in the form of a spiral groove 68 leaving only a small thickness at the bottom of the groove 68. The groove 68 confines a flat coil 70, whose internal winding 72 is connected to the arcing contact 46 and whose external winding 74 is connected to the arm 34. The current input by the arm 34 flows mostly through the coil 70, only a small part flowing through the base-plate 42, and generates an axial magnetic field in the zone of the contact parts 50 where the arc is drawn when these contact parts 50 separate. The axial field ensures diffusion of the arc and thus enables a high breaking capacity to be obtained. The stray fields, due to the currents induced in the contact parts 50, are greatly attenuated, as the intensity of these induced currents is itself limited by the strong resistance of the contact parts 50 made of refractory material. A small vacuum cartridge with a high breaking capacity can thus be achieved by very simple means. The vacuum cartridge 38 can naturally comprise protective shields (not represented) of the housing 40, the one on the stationary arcing contact 46 side being advantageously replaced by the external winding 74 of the coil 70. The coil 70 is not necessarily formed from the mass of the base-plate 42 and can be formed by a spiral conductor fixed by any suitable means to the base-plate 42. This embodiment is mandatory if the base-plates 42, 44 of the cartridge 38 are insulating.

It is advantageous to achieve a vacuum cartridge that can be used for a whole range of circuit breakers, for the gain in size and in cost is low if the characteristics of the cartridge are adapted exactly to suit those of the circuit breaker. Localizing breaking and the arc in a separate sealed enclosure is particularly advantageous for metal-clad substations or other gas-insulated installations, for any arc propagation or insulating gas pollution is thus avoided. The parallel arrangement of the arcing contacts 46, 48 and main contacts 26, 30, more particularly described, favors high-speed current switching, but other arrangements can be used and the design of the circuit breaker can be different. It is possible to integrate an earthing device housed in the sealed enclosure 10 and actuated by the operating shaft 52 after opening of the circuit breaker. The main contacts 26, 30 and the operating mechanism can naturally be achieved differently without departing from the scope of the present invention.

We claim:

1. A medium voltage electrical circuit breaker comprising:

a sealed enclosure (10) filled with sulfur hexafluoride;

two main contacts (26, 30) disposed in said sealed enclosure (10);

a vacuum cartridge (38) disposed in said sealed enclosure (10);

a pair of arcing contacts (46, 48) disposed in said vacuum cartridge (38) and electrically connected and parallel to said main contacts (26, 30), said pair of arcing contacts (46, 48) being at least partially defined by disk-shaped contact parts (50) made of high resistive material;

an operating mechanism mechanically connected to said main contacts (26, 30) to open said arcing contacts (46, 48) after said main contacts (26, 30) open, and to close said arcing contacts (46, 48) before said main contacts (26, 30) close;

magnetic field generating means (70) for producing a magnetic field axially about said arcing contacts (46, 48) in said vacuum cartridge (38); and a cylindrical housing (40) at least partially defining said vacuum cartridge (38) and co-axially surrounding said arcing contacts (46, 48), wherein an axial length of said cylindrical housing (40) corresponds to a dielectric withstand of said cylindrical housing (40) in sulfur hexafluoride.

2. The device of claim 1, wherein said vacuum cartridge (38) further comprises metal base-plates (42, 48) disposed at opposite ends of said cylindrical housing (40) to seal said opposite ends of said cylindrical housing (40).

3. The device of claim 1, wherein said high resistive material is a refractory material selected from the group consisting of tungsten and chrome, or mixtures thereof.

4. The device of claim 2, wherein said arcing contacts (46, 48) are defined by a slidably movable arcing contact (48) and a stationary arcing contact (46) axially mounted in said vacuum cartridge (38), wherein said base-plate (42) of said vacuum cartridge (38) is disposed adjacent to said stationary contact (46), and wherein said magnetic field means (70) is defined by a coil adjacent to said base plate (42), co-axial to said cylindrical housing (40) and electrically connected in series to said arcing contacts (46, 48).

5. The device of claim 4, wherein said coil has windings confined by a spiral groove (68) in said base-plate (42).

6. The device of claim 4, wherein said coil has windings fixed to an internal face of said base-plate (42).

* * * * *